US005484077A

United States Patent [19]

Albanesi et al.

[11] Patent Number: 5,484,077

[45] Date of Patent: Jan. 16, 1996

[54] PACKAGING SYSTEM INCLUDING SMALL FRAME WITH INTEGRAL LID, BAG AND EXTERNAL CONTAINER

[75] Inventors: Mario Albanesi; Luigi Bonifaci, both of Rome, Italy

[73] Assignee: The Procter & Gamble Company, Cincinnati, Ohio

[21] Appl. No.: 117,172

[22] PCT Filed: Jan. 31, 1992

[86] PCT No.: PCT/US92/00814

§ 371 Date: May 9, 1994

§ 102(e) Date: May 9, 1995

[87] PCT Pub. No.: WO92/16439

PCT Pub. Date: Oct. 1, 1992

[30] Foreign Application Priority Data

Mar. 13, 1991 [IT] Italy ..... MI91A0664

[51] Int. Cl.[6] ..... B65D 5/68

[52] U.S. Cl. ..... 220/404; 220/640

[58] Field of Search ..... 220/640, 642, 220/403, 404; 229/199

[56] References Cited

U.S. PATENT DOCUMENTS

| | | | |
|---|---|---|---|
| 3,129,867 | 4/1964 | Schroeder | 220/404 X |
| 3,337,086 | 8/1967 | Jenks | 220/404 |
| 4,444,355 | 4/1984 | Cary | 220/404 X |
| 4,560,085 | 12/1985 | Vom Hofe et al. | 220/404 X |
| 4,598,838 | 7/1986 | Zakrajsek | 220/404 |
| 4,765,579 | 8/1988 | Robbins, III et al. | 220/404 X |
| 5,211,305 | 5/1993 | Horton | 220/404 X |

*Primary Examiner*—Steven M. Pollard
*Attorney, Agent, or Firm*—Ronald W. Kock

[57] ABSTRACT

An improved system for sticking a frame with an integral lid to a flexible bag and to a rigid external container into which the bag is inserted. The improved system includes a frame having a flange and a peripheral groove. The flange has a lower surface and the lower surface has a surface-finish which has channels formed therein to promote the distribution of an adhesive. Also included is a bag having a flat upper surface and an external container having an upper edge. The upper edge has a finish of reliefs and hollows. There is an adhesive between the upper edge of the external container the peripheral groove in the frame and between the lower surface of the flange and the upper surface of the bag. The lower surface of the flange has an increased surface area due to the channels in order to increase sticking action between the bag and the flange. The reliefs and hollows of the upper edge of the external container increase sticking action between the frame and the external container.

1 Claim, 3 Drawing Sheets

PACKAGING SYSTEM INCLUDING SMALL FRAME WITH INTEGRAL LID, BAG AND EXTERNAL CONTAINER

The present invention relates to a system for sticking a small frame with integral lid made of plastic material to a bag and to an external container, into which the bag itself is inserted so as to form as a whole a boxed packaging which is hermetically sealed during the use of the packaging.

Packagings of this type are already known, which are formed by an internal bag of square shape containing for example, roast and ground coffee packed under vacuum, by an external container, usually a box made of card, and by a small frame with integral lid made of plastic material which is joined both to the internal bag and to the external container.

Such packagings generally have an unsatisfactory join both between the lower surface of the flange of small frame and the internal bag, and between the upper edge of the external container and the small frame itself. This leads to imperfect airtightness which compromises the preservation of the aroma of the product, in particular in the case of coffee, once the user has opened the wall of the bag appearing in the opening delimited by the flange, notwithstanding the good hermetic sealing existing between the lid and the upper rim of the small frame, which is ensured by a gasket.

The aim of the present invention is to equip the small frame with integral lid made of plastic material with a sticking system which has the following advantages in relation to the other versions already on the market:

a) better adhesion of the flange of the small frame with integral lid to the surface of the internal envelope, represented in this case by a bag under vacuum;

b) better airtightness of the sticking zone between the flange and the bag, and c) greater adhesion of the small frame to the external container, represented for example by a cardboard envelope.

The excellent adhesion characteristics obtained using the sticking system according to the invention render the packaging more hermetic and more resistant to the conditions of stress which are often brought about during transport and use in the domestic environment.

The sticking system has been developed, in a specific manner, for a packaging for roast and ground coffee, packaged under vacuum, although the same is also applicable to different categories of product such as, for example, peanuts, biscuits, cocoa or the like or detergents packaged in types of packaging having a boxed envelope.

In general, the invention guarantees a better method of sticking an element made of plastic material, represented for example by a dispensing member, to a container.

According to the invention, the sticking system is based on the combination of one or more of the following characteristics:

a) pan of the groove for sticking the flange of the small frame made of plastic material, in which the edges of the external container are inserted, has branched sticking fins. These branched fins guarantee a more extensive three-dimensional and multidirectional contact with the glue, through the sticking planes, by means of multiple orientation in space. As a result of the greater surface area of the specific zones of the small frame which are exposed to the glue and of the appropriate orientation of the sticking fins, the adhesion force, when the external container is stuck to the small frame, is greater.

b) The lower surface of the flange of the small frame made of plastic material is corrugated instead of smooth. This shaped finish of the sticking flange renders its surface non-uniform and therefore the layer of glue which connects the small frame to the bag is distributed three-dimensionally. This increases the surface area of the small frame available for adhesion, divides the stress of detachment into components of elongation and shear and thus improves the adhesion between the small frame and the sticking means. Moreover, the incorporation of lines of continuity along the entire periphery of the shaped part renders the sticking more airtight by means of the barriers presented to the exchange of gases from one side to the opposite side of the layer of glue.

c) It is moreover envisaged that the upper edge of the external container to be connected to the flange has a non-uniform finish of the surface instead of a flat smooth finish. This non-uniform finish of the upper edge of the container also permits the making of three-dimensional and multidirectional contact with the areas of glue, increasing in this manner the surface area of the container available for adhesion, and distributing the stress into components of elongation and shear.

Packagings with a boxed envelope are already known, such packagings involving the use of a lid made of plastic material stuck both to the internal bag and to the external container. However, the adhesion properties and the strength of the packaging are in general limited as a result of the smooth and uniform surface available for adhesion between the parts.

Moreover, the sticking ribs used in packagings of the prior art to fix the small frame with integral lid to the external container provide a limited surface area for adhesion, while the branched structure of the fins, according to the invention, guarantees a multiaxial orientation of the sticking surfaces capable of increasing the adhesion in all necessary directions.

Also known is a uniform and smooth sticking flange of the small frame, which is used to connect a small frame with integral lid made of plastic material to a support surface. The shaped, non-uniform design of the sticking flange, according to the present invention, provides a three-dimensional and multidirectional orientation of the sticking surface, with a consequent increase in the adhesion force in all directions. The lines of continuity in the sticking arrangement guarantee better airtightness when barrier properties are required of the glue zones. Moreover, the surface finish of the sticking flange limits the discharge of the glue when the two elements are connected and the surface finish itself also permits a suitable distribution of the excess glue according to a preferred direction, increasing in this manner the adhesion in other parts of the surface.

The non-uniform finish of the upper sticking edges of the external container, likewise envisaged by the present invention, guarantees lastly a much better adhesion in relation to the flat and uniform finish of the sticking surface in all the packagings with boxed envelope known today.

Further details may be drawn from the following description of a preferred, but not exclusive, exemplary embodiment of the present invention and of a number of alternatives, with reference to the attached drawings, in which similar reference numbers refer to corresponding elements in the figures of said drawings, and in which.

Figure 1:
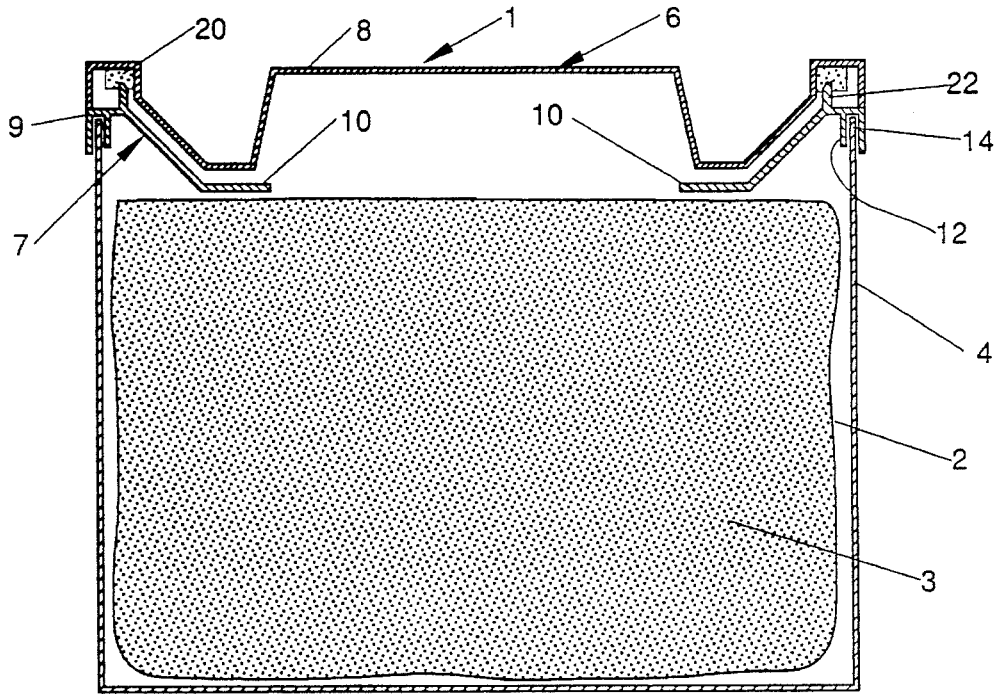
FIG. 1 represents diagrammatically in vertical transverse cross-section a packaging of the type considered in the present invention.

In FIG. 1, the boxed packaging for a granular product, of the type considered in the present invention, is represented diagrammatically in longitudinal cross-section. This packaging, indicated as a whole by 1, comprises an internal bag 2 of essentially parallelepipedal shape, which contains any product 3, for example roast and ground coffee packed under vacuum, an external container 4, constituted for example by a box made of card, and a lid indicated as a whole by 6, which is formed by a small frame 7 which is integral with a closure lid 8 which pivots about a hinge 9 of the same material as the small frame itself.

Figure 2:
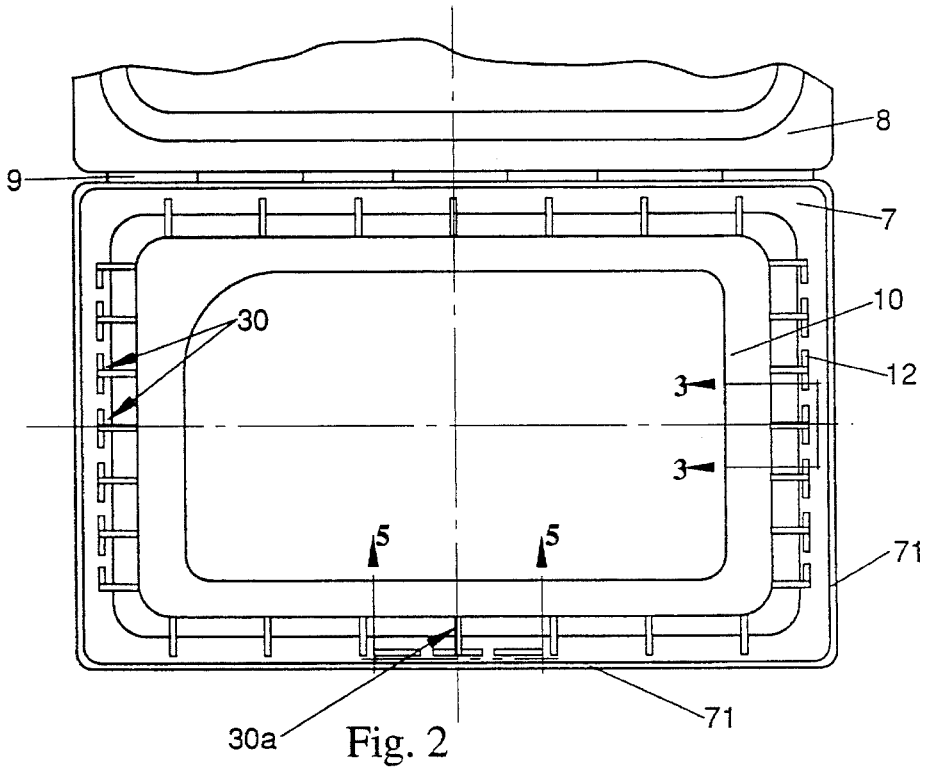
FIG. 2 represents the view from the bottom towards the top of the small frame with integral lid for closure of the packaging.

The small frame 7 takes the form (see also FIG. 2) of a shaped frame provided with a flange 10, the lower surface of which has to be fixed impermeably, by means of sticking, to the upper wall of the bag 2, said small frame also being equipped with a peripheral connecting groove 12 capable of retaining, also by sticking, the edge 14 of the external container 4.

Of said elements 10 and 12, subject of the improvements of the present invention, the first is particularly critical and important, as it has to constitute optimum airtightness in order to prevent the decline of the organoleptic properties of the product contained in the internal bag once it has been opened as, during use, reliance is placed upon good tightness of the closure lid 8 which is equipped with a gasket 20 which bears against the rim 22 of the small frame 7. The groove 12 intended to retain by sticking the edge of the external container 4 is critical on the other hand in order to obtain on the whole a solid packaging which is reliable against the mechanical stresses of transport and of use.

Figure 4:
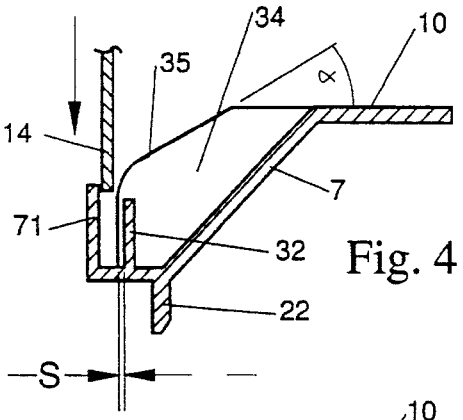
FIG. 4 represents the cross-section according to the lane IV—IV of one of the fins in FIG. 3.

According to the invention, in order to improve the join of the edge 14 of the container 4 introduced into the groove 12:, there is provided, by way of example on two opposite sides of the small frame, a plurality of branched fins 30 (see also FIGS. 3 and 4), each of which consists of a plate 32 connected to a rib 34 which is integral with the wall of said small frame.

The rib 34 appears for a limited projection S on the plane of the plate 32, creating a non-uniformity which contributes to better adhesion of the edge 14 of the wall of the external container 4 introduced into the groove 12.

The back 35 of the ribs 34 is inclined in relation to the plane of the flange 10 in order to constitute an invitation and a guide for the edge 14 of the wall of the external container 4 during the preparation of the packaging, which is usually automated.

Figure 3:
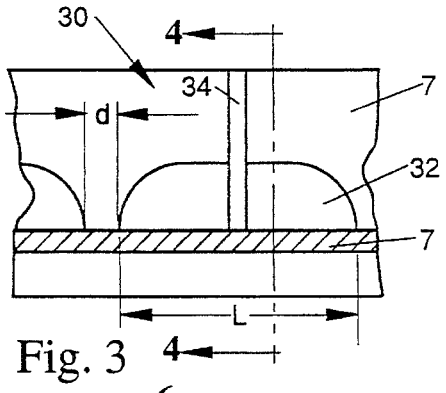
FIG. 3 represents on enlarged scale the detail of a section of the branched fins provided, by way of example, on the shorter sides of the small frame seen in the direction III—III in FIG. 2.

The plates 32 of the branched fins 30 can assume any other shape and size than that illustrated in FIG. 3.

Figure 6:
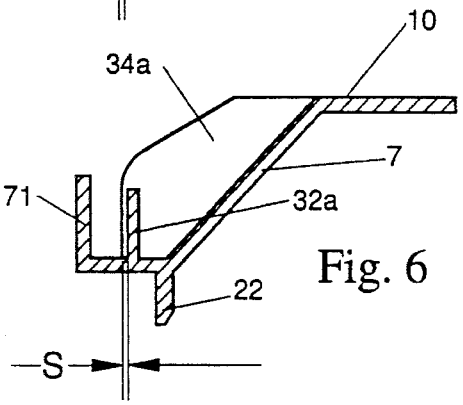
FIG. 6 represents the cross-section according to the line VI—VI of the fin in FIG. 5.
Figure 5:
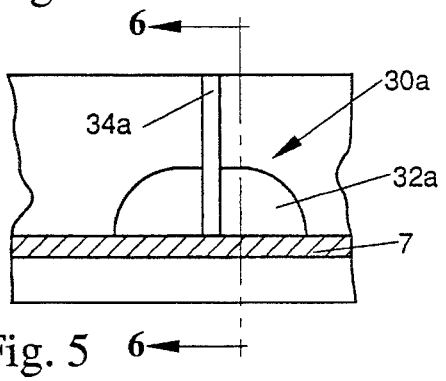
FIG. 5 represents the cross-section according to the line V—V in FIG. 2 of the branched fin arranged in the front part of the flange of the small frame.

It is envisaged that at least one branched fin **30*a* of the type previously described is also applied in the front central zone of the small frame (see FIGS. 2, 5 and 6**) for the same purposes.

Figure 7:
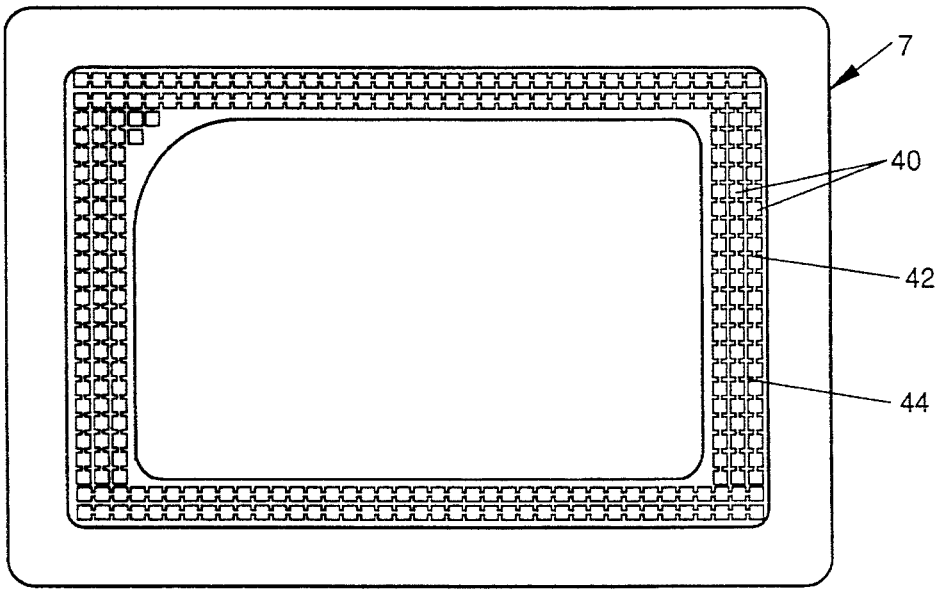
FIG. 7 represents a preferred type of surface finish, according to the invention, of the lower peripheral surface of the flange of the small frame.

A further provision of the present invention aimed at better sticking of the upper wall of the internal bag 2 to the lower surface of the flange 10 is to give said zone a corrugated surface finish, as indicated by way of illustration in a preferred exemplary embodiment in FIG. 7.

To this end, the surface of the flange 10 is for example equipped, during surface finishing, with a plurality of elements 40 in slight relief, interconnected by a joining section 42 so as to form a number of barrier lines interposed between small channels 44.

Figure 8:
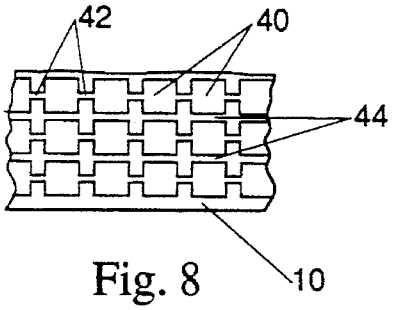
FIG. 8 represents on enlarged scale the detail of a section of the surface finish of the flange illustrated in FIG. 7.
Figure 9:
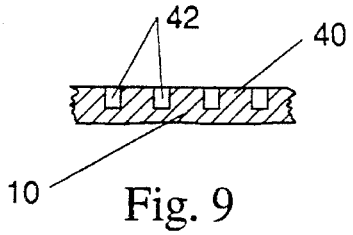
FIG. 9 represents the cross-section according to the line IX—IX in FIG. 8, of a section of a row of surface finish elements of the flange.

An enlarged detail of this preferred solution is illustrated in FIGS. 8 and 9, in plan view and cross-section respectively. This surface finish, the elements 40 of which can assume the most varied geometrical shapes, gives rile to a multiplicity of corners and recesses which multiply the possibility of joining of the respective contact surfaces of the flange and of the bag, while at the time of the sticking operation the glue can if necessary be distributed more uniformly by running along the small channels 44. At the same time, the multiple barrier constituted by a number of rows of elements 40 prevents, when sticking has taken place, the passage of external air, guaranteeing hermetic sealing of the packaging during use.

Figure 10:
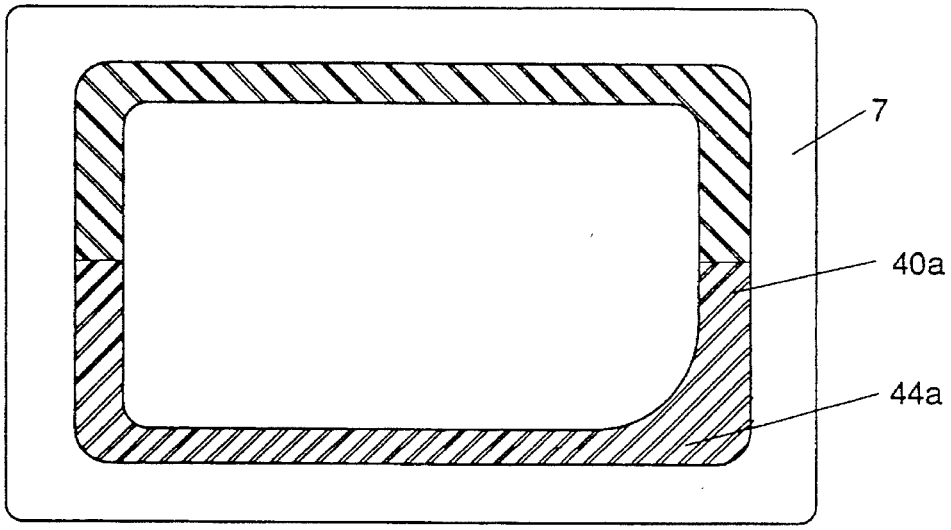
FIG. 10 represents diagrammatically on reduced scale in relation to FIG. 7 one of the possible alternatives, within the scope of the inventive idea, of the surface finish design of the lower surface of the flange of the small frame.

The shaping of the surface finish reliefs of the surface of the flange 10 and the incorporation of barrier lines to prevent the passage of air can clearly be effected in different ways. Remaining within the scope of the inventive idea, a possible alternative to the solution illustrated in FIG. 7 can be that shown diagrammatically in FIG. 10 for example.

Figure 11:
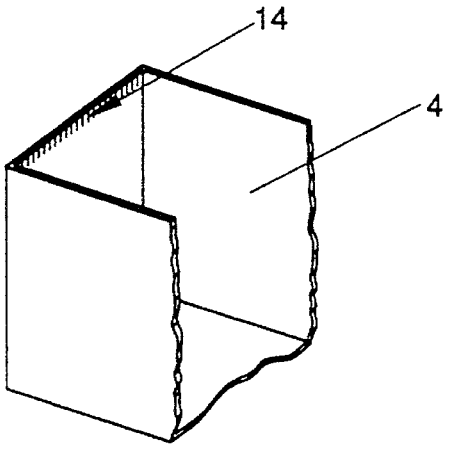
FIG. 11 represents diagramatically in perspective the surface finish of the upper rim of the external container, by way of example, of at least one of its sides, to improve adhesion of the wall of the external container to the small frame.
Figure 12:
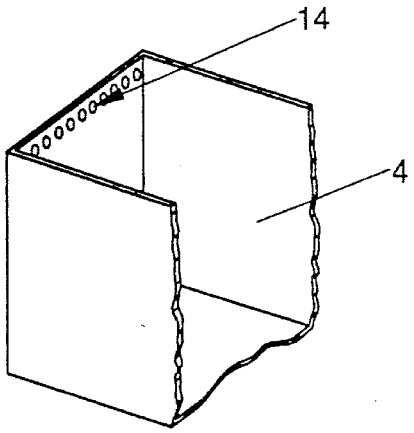
FIG. 12 represents one of the possible surface finish alternatives of said rim, as an alternative to that illustrated in FIG. 11.

According to the invention, it is envisaged that the edge 14 also of the external container 4 has a nonuniform finish over some or all of the surface as indicated for example in FIGS. 11 and 12. This type of finish, which is made using undulations or grooves in the thickness of the card or using rows of hollows or of reliefs or in any other manner known to experts in the field, increases the surface area of the edge 14 of the container available for adhesion.

The branched fins, which are integral with the flange of the lid and arranged within the lower peripheral groove of the small frame, can have any shape and size, provided that they make it possible to establish three-dimensional and multidirectional contact between the layer of glue and the sticking elements. The sticking surfaces of the branched fins can be arranged in any position and have any spatial orientation in relation to the surface of the other element, with which the connection has to be established. The other element which has to be connected can have any shape and any size. The branched fins can constitute part of an article made using any material.

The surface finish of the sticking flange of the small frame can have any configuration and any dimensional relationship between the projecting parts and the hollowed parts. This surface can include any number of scoring lines and channels of any size, oriented in any direction. It can include any number of continuity projections so as to increase the airtightness and can belong to an article made using any material.

The shaped surface of the edge of the other element which is to be connected to the small frame, represented in the specific case by the wall of the external container, can have any configuration and any dimensional relationship between the projecting and hollowed parts. It can include any number of projections or grooves oriented in any direction. When the shaped surface is obtained by means of embossing geometrical figures on the edges, the geometrical figures can have any configuration and size. The other element which is to be connected, that is to say the external container, can have any configuration and size and can be made using any material.

It is also understood that the glue used to connect the two parts can be of any type.

The sticking system according to the invention leads to greater adhesion between the parts of the packaging, an increase in the airtightness of the sticking zone between lid and bag and greater resistance to the mechanical stresses due to transport, to handling and to use of the packaging.

We claim:

1. An improved system for sticking a frame with an integral lid to a flexible bag and to a rigid external container into which said bag is inserted, said system comprising:

a) a frame having a flange and a peripheral groove, said flange having a lower surface, said lower surface having a surface-finish which has channels formed therein to promote the distribution of an adhesive;

b) a bag having a flat upper surface;

c) an external container having an upper edge, said upper edge having a finish of reliefs and hollows; and d) an adhesive between said upper edge of said external container and said peripheral groove in said frame and between said lower surface of said flange and said upper surface of said bag, said lower surface of said flange having an increased surface area due to said channels in order to increase sticking action between said bag and said flange, and said reliefs and hollows of said upper edge of said external container increasing sticking action between said frame and said external container.

* * * * *